United States Patent [19]

Chubb

[11] 4,049,091

[45] Sept. 20, 1977

[54] ATTACHE CASE AND THE LIKE

[75] Inventor: Wayne L. Chubb, Porter, Ind.

[73] Assignee: Faircraft Engineering, Inc., Porter, Ind.

[21] Appl. No.: 690,374

[22] Filed: May 27, 1976

[51] Int. Cl.[2] ..... A45C 5/04

[52] U.S. Cl. ..... 190/18 R; 190/42

[58] Field of Search ..... 190/11, 12 R, 12 A, 190/18 R, 16, 42

[56] References Cited

U.S. PATENT DOCUMENTS

| | | | |
|---|---|---|---|
| 240,057 | 4/1881 | Waldecker | 190/11 UX |
| 940,421 | 11/1909 | Bain | 190/18 R |
| 988,937 | 4/1911 | Holland | 190/18 R X |
| 1,770,156 | 7/1930 | Hoyer | 190/11 UX |
| 3,298,478 | 1/1967 | Soprani | 190/18 R X |

FOREIGN PATENT DOCUMENTS

| | | | |
|---|---|---|---|
| 551,911 | 1/1923 | France | 190/11 |

*Primary Examiner*—Donald F. Norton
*Attorney, Agent, or Firm*—Marmaduke Hobbs

[57] ABSTRACT

An attache case and the like having a lower section and an upper section, in which the side panel of the lower section is provided with a recess for receiving legs for supporting the case. The legs may be attached directly to the side panel in the recess or they may be attached to a board or to a top which will seat in the recess and also form a portion of the exterior of the side panel when the legs are folded and seated in the recess. A means is provided for releasably retaining the legs and the top in the recess so that the legs and top can be carried along with the case and be available for setting up the case on the table whenever the case is to be used. As an alternative, the table may be carried in the case, and when the case is to be used, the legs are unfolded and the case is seated on the top with the top in the recess. The recess may be either an indentation in the side panel of the lower section or it may be defined by ribs along the periphery of the side panel.

5 Claims, 8 Drawing Figures

ATTACHE CASE AND THE LIKE

Attache cases are often used for office calls and conferences wherein the case is placed on a desk or chair with the case open so that the user has access to the papers and other material in the case as the conference proceeds. Often a chair or adequate desk top space is unavailable for the conference, and the user is compelled to use the floor or his lap for holding the case while he shuffles through the material in the case during the conference. Further, the user occasionally needs to make notes or write memoranda during the conference or in other places where a desk or table is not available, and, in the past, has been required either to use the side of the case or an internal panel of the case for this purpose while the case is held on the user's lap or supported by a chair or other piece of furniture. It is therefore one of the principal objects of the present invention to provide an attache case and similar cases with legs which serve as a stand for the case to permit the case to be open and used in a convenient manner and at a convenient height without relying on a chair, desk or other furniture as a support for the case, and which will fold into a compact condition to permit the case to be easily carried in the conventional manner.

Another object of the invention is to provide a combination attache case or the like and a foldable table, in which the table can be carried either internally or externally as a part of the case and can be unfolded and used as a separate table or used to support the case while it is open and in use.

Still another object of the invention is to provide a case of the aforesaid type which is compact and easy to carry, and which can readily be set up for use in a conference without occupying any more floor space than the normally open case, and can be quickly folded into condition for carrying when the conference has been concluded.

A further object is to provide an attache case or similar case having permanently attached legs, or legs attached to a removable table, for use in conjunction with the case, in which the legs are recessed or concealed in the case when they are not in use and are easily unfolded or extended therefrom when the case is to be opened and supported for access to the material therein.

Additional objects and advantages of the present invention will become apparent from the following description and accompanying drawings, wherein.

Figure 1:
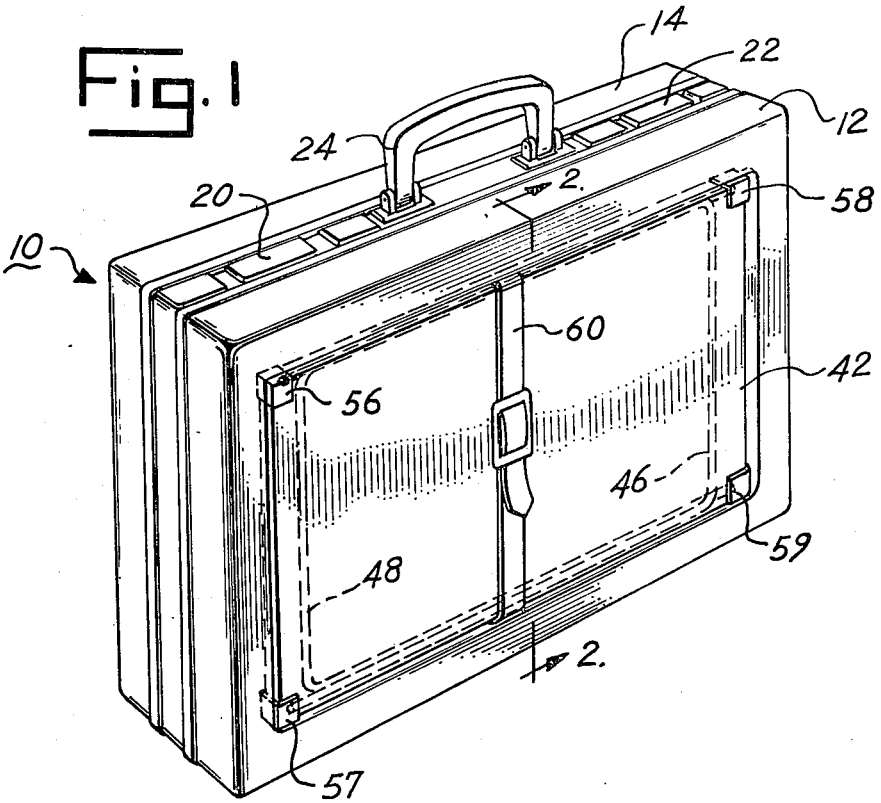
FIG. 1 is a perspective view of an attache case illustrating one embodiment of the present invention and showing the case in its folded and closed position.
Figure 2:
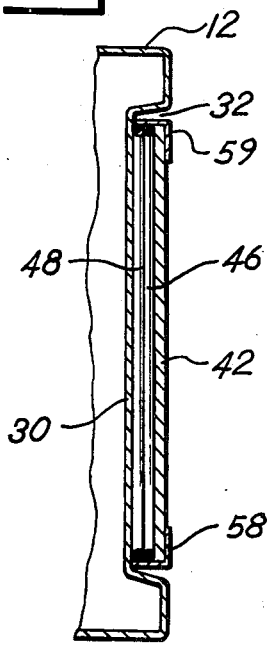
FIG. 2 is a fragmentary vertical cross sectional view of the case shown in FIG. 1, the section being taken on line 2—2 of the latter figure.
Figure 3:
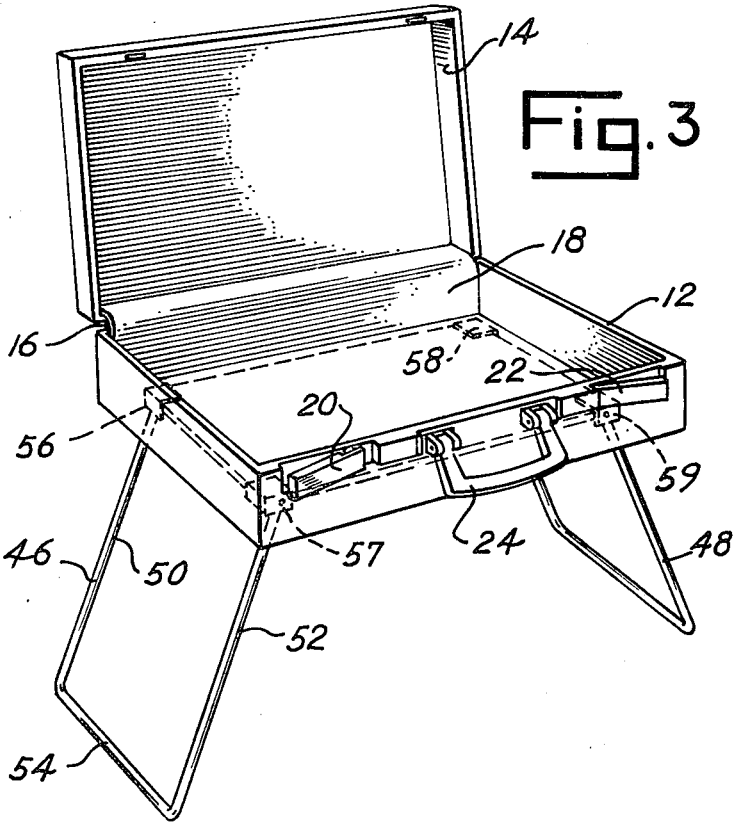
FIG. 3 is a perspective view of the case shown in FIG. 1, illustrating the case in its unfolded and open condition.
Figure 4:
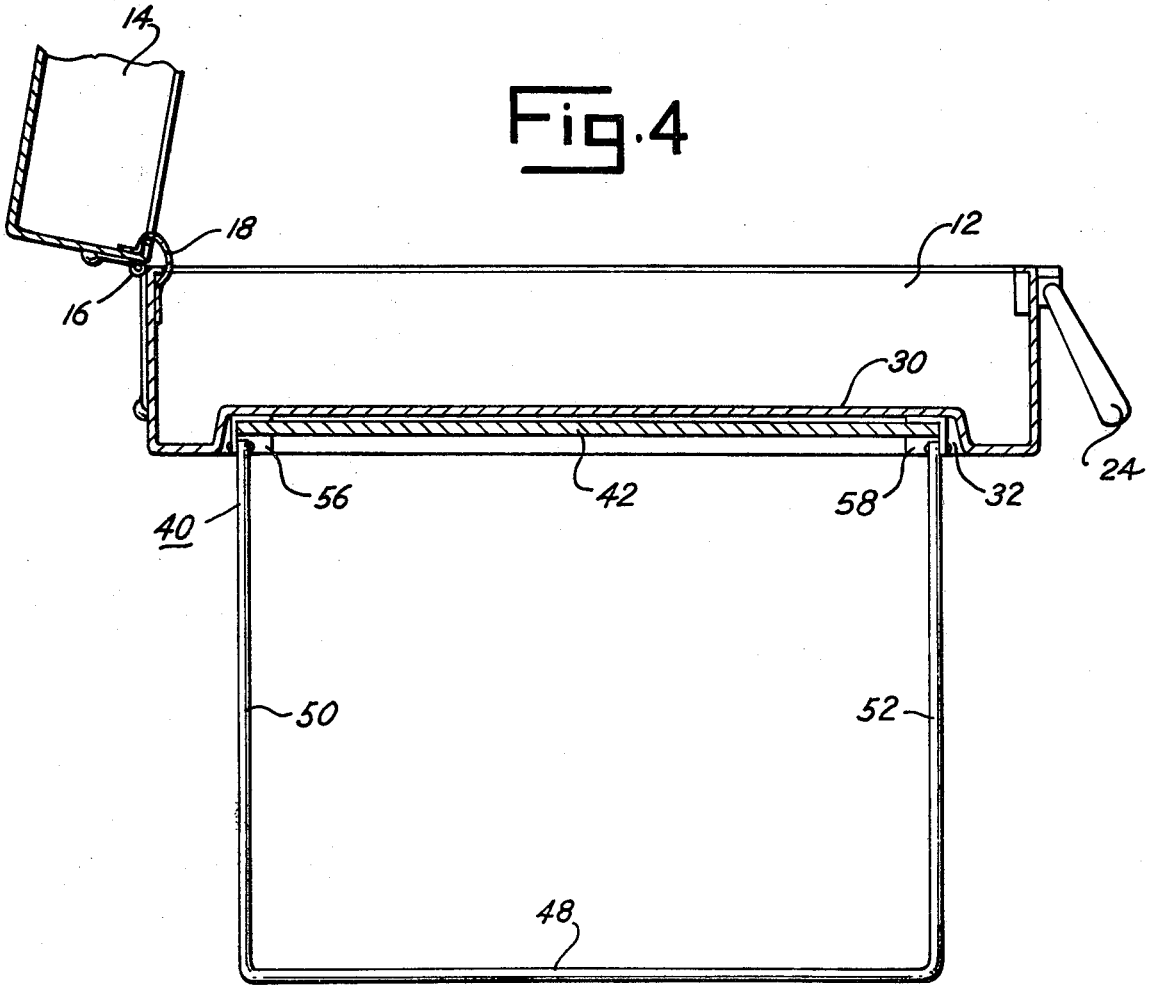
FIG. 4 is a fragmentary vertical cross sectional view of the case shown in FIG. 3, illustrating the case in its unfolded and open condition.

Referring more specifically to the drawings, and to the embodiment disclosed in FIGS. 1 and 4, numeral 10 indicates generally an attache case having a bottom section 12 and a top section or cover 14, the two sections being connected by hinge 16 so that the top section pivots from closed position to over-center position seen in FIG. 3. A liner of plastic material 18 or the like prevents the cover from pivoting further from the over-center position. The two sections are locked together when closed by a couple of latches 20 and 22 of any suitable construction, and a handle 24 connected to the bottom section is provided to assist in carrying the case. The case may be made of a variety of different materials, however, preferably a suitable plastic material, such as vinyl, is used, the material also being preferably sufficiently rigid that the two sections will retain their shape with little or no reinforcing structure, either internally or externally, for the side walls and bottom. The case as thus far described is essentially the same as any conventional attache case; however, different sizes and shapes may be used to meet various requirements. A number of pockets may be included in either the bottom or top sections, or both, and these pockets may be permanently or removably installed in the case.

In the embodiment of the invention illustrated in FIGS. 1 through 4, side panel 30 of bottom section 12 is recessed to provide preferably a rectangular recess 32 occupying a substantial part of the side, and the bottom panel is formed integrally with the side walls of the bottom section. In this embodiment, a table or stand, indicated generally by numeral 40, when in folded position, is disposed in recess 32, preferably with the panel forming the top 42 of the table facing outwardly. The top may be of the same material, or finished in the same manner, as the remainder of the case so that the panel effectively closes most of the recess and forms an appearance of a substantially solid side on the panel of the bottom section. The top 42 is supported by two U-shaped legs 46 and 48, each leg having vertical members 50 and 52 and a cross member 54 connected integrally to the lower ends of the two vertical members. The upper ends of the leg members are pivotally connected to fixtures 56, 57, 58, and 59 secured to the underside of top 42, the fixtures permitting the legs to fold inwardly to the position illustrated in broken lines in FIG. 1 and to fold outwardly to the positin shown in FIG. 3 where the legs are held by the fixtures from spreading angularly outwardly any further than the position shown. The legs thus form a firm support for the table top and the case placed thereon in the manner illustrated in FIGS. 3 and 4.

When the table 40 is in its folded condition, it is placed in recess 32, and clips or a strap such as that indicated at numeral 60, retains the table in the recess. The two ends of the strap are secured to the side of lower section 12, preferably in the recess. While other types of clips or securing means may be used to retain the table in the recess, preferably the type should be easily released so that the table can be easily and quickly set up.

In the use of the attache case disclosed in FIGS. 1 through 4, the table is released and set up with the legs in the position illustrated in FIG. 3 and the case is placed on panel 42 disposed in the recess. The sides of the recess retain the case firmly in place on top 42 so that it will not slide or otherwise become easily displaced while the case is being used. When the case is to be carried, the table is folded and inserted in the recess in the position shown in FIG. 1; however, in some situations, it may be desirable to place the table in the recess with the panel facing inwardly so that the case and table can be set up by merely releasing the legs while retaining the panel 42 in place in the recess.

Figure 5:
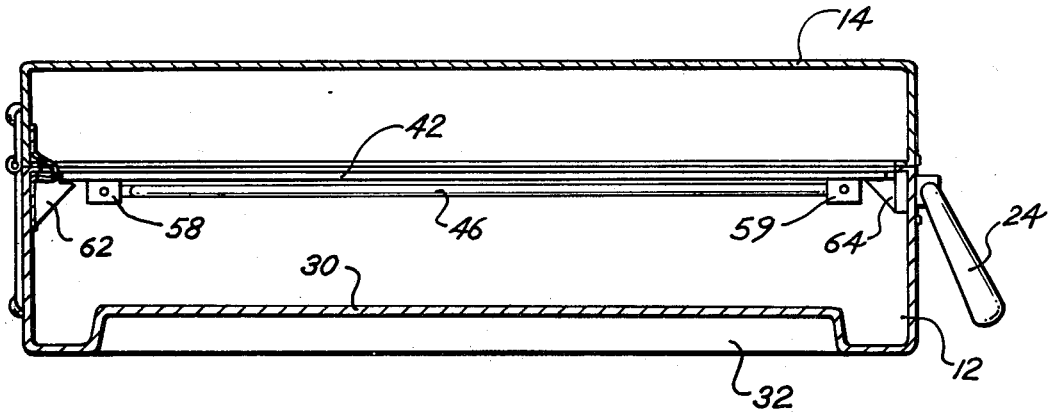
FIG. 5 is a vertical cross sectional view of an attache case, illustrating another embodiment of the present invention with the case in closed position.

In the embodiment shown in FIG. 5, recess 32 may or may not be included in the side panel of lower section 12. In place of carrying the table in the recess, the table is placed on fixtures 62 and 64 on the rear and front sides of the internal part of the lower section 12. Thus, panel 42 forms a partition in the case which can be used as a desk when the top section 14 is in its raised position as illustrated in FIG. 3. When the table is to be used as a stand for the case, it is removed from the case and unfolded, and the case is placed over the top with the panel seating in recess 32 if the recess is provided in the side of section 12. The table shown in FIG. 5 is essentially the same as the one shown in the preceding figures; however, it may be slightly larger to fully close the compartment in lower section 12 of the case.

Figure 6:
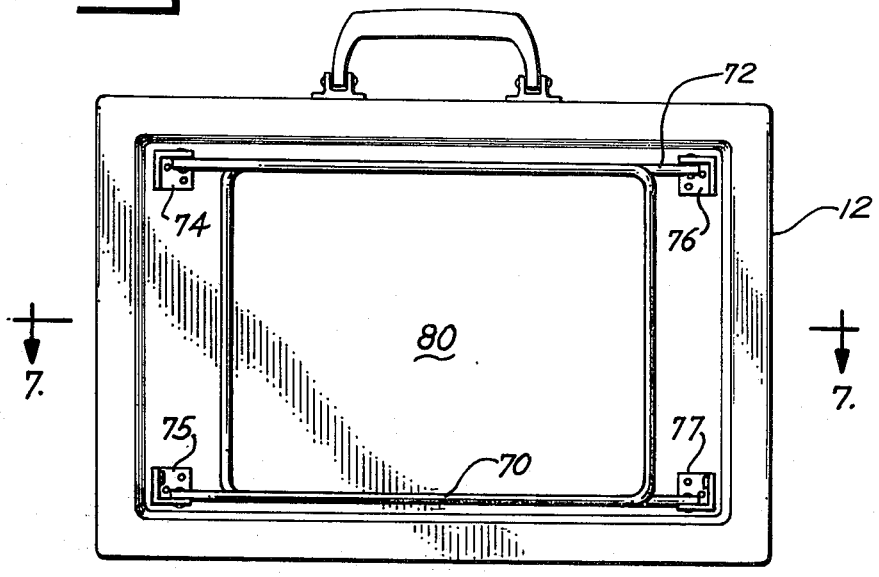
FIG. 6 is a side elevational view of an attache case illustrating a further modified form of the invention, showing the case in its folded and closed condition.
Figure 7:
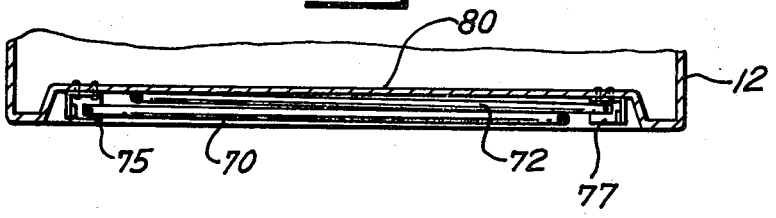
FIG. 7 is a fragmentary horizontal cross sectional view of the case shown in FIG. 6.
Figure 8:
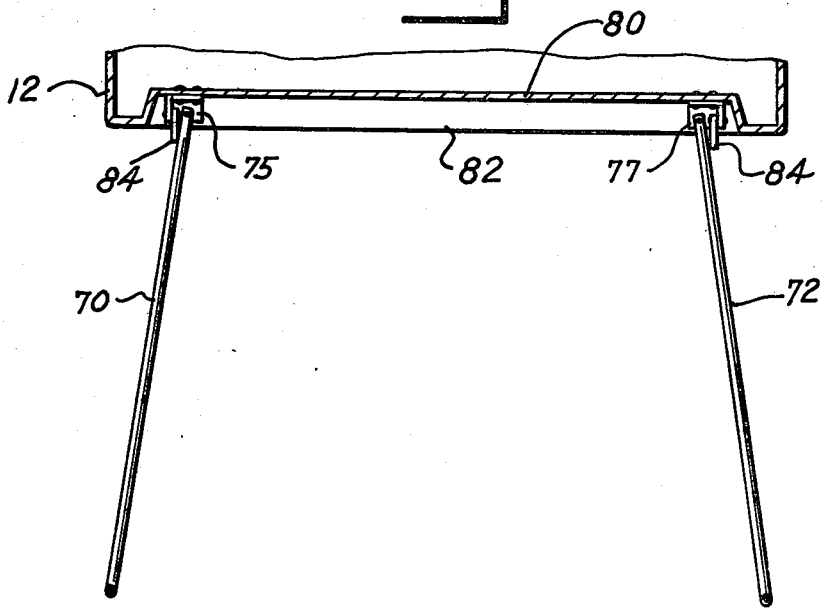
FIG. 8 is a fragmentary cross sectional view similar to the cross sectional view of FIG. 7, but illustrating the case in its unfolded condition.

In the embodiment of the invention illustrated in FIGS. 6, 7 and 8, the legs 70 and 72, which are substantially the same as legs 46 and 48, are secured by fixtures 74, 75, 76, and 77 directly to side panel 80 of lower section 12. Preferably, the fixtures are disposed in a recess 82 so that, when the legs are folded in the manner illustrated in FIGS. 6 and 7, they do not project outwardly beyond the periphery of the side wall of section 12. The two legs are pivoted to their respective fixtures and are held in an upright position by lugs 84 on the fixtures. These lugs preferably do not project appreciably beyond the periphery of the side wall, and other types of stop means may be used to locate the legs in the proper unfolded position. The case is otherwise the same as shown in the preceding figures and previously described herein. The primary disadvantages of this modified form is the lack of versatility, in that in the prior embodiment the stand is usable as a table apart from the case and the case and table can readily be separated in setting up or taking down the stand and case. Further, in the prior embodiment, the top panel 42 becomes a part of the side of section 12 when the table is folded and clipped in place in recess 32 in the manner illustrated in FIG. 1, thus concealing the legs. Although recesses 32 and 82 are shown as indentations in the side panel of section 12, the recess may be formed by a protruding rib extending around section 12 near the periphery of the panel. A strap such as strap 60, or other suitable clips, are used to retain the legs in the recess when they are folded inwardly as illustrated in FIGS. 6 and 7.

While several embodiments of the present combination case and table or stand have been described in detail herein, various changes and modifications may be made without departing from the scope of the invention.

I claim:

1. An attache case and the like, comprising a lower section having a side panel, an upper section hinged to said lower section, means on said side panel forming a recess, legs foldable into said recess, a reversible top insertable in said recess, and means secured to said top pivotally holding said legs near each end of said recess and pivoting said legs outwardly for supporting the case, said top being substantially the same size and shape as said recess for enclosing said legs in said recess when the legs are in folded position and when the top is disposed in the recess with the legs between the bottom of the recess and the top.

2. An attache case and the like as defined in claim 1 in which said recess is a generally rectangular indentation in the side panel of the lower section and extends substantially over most of the area of said panel.

3. An attache case and the like as defined in claim 1 in which a means attached to said lower section releasably retains said top and legs in said recess.

4. An attache case and the like as defined in claim 1 in which said sections are constructed of plastic material.

5. An attache case and the like as defined in claim 1 in which said lower section is constructed of plastic material.

* * * * *